US006213206B1

(12) United States Patent
Bakke

(10) Patent No.: US 6,213,206 B1
(45) Date of Patent: Apr. 10, 2001

(54) HYDRAULICALLY RELEASABLE COUPLING

(75) Inventor: Stig Bakke, Ålgård (NO)

(73) Assignee: Transocean Petroleum Technology AS, Tananger (NO)

( * ) Notice: Subject to any disclaimer, the term of this patent is extended or adjusted under 35 U.S.C. 154(b) by 0 days.

(21) Appl. No.: 09/125,132

(22) PCT Filed: Feb. 5, 1997

(86) PCT No.: PCT/NO97/00035

§ 371 Date: Aug. 11, 1998

§ 102(e) Date: Aug. 11, 1998

(87) PCT Pub. No.: WO97/29270

PCT Pub. Date: Aug. 14, 1997

(30) Foreign Application Priority Data

Feb. 12, 1996 (NO) ..... 960540

(51) Int. Cl.[7] ..... E21B 23/00
(52) U.S. Cl. ..... 166/242.7; 166/377
(58) Field of Search ..... 166/377, 242.6, 166/242.7; 299/39

(56) References Cited

U.S. PATENT DOCUMENTS 4,526,233 7/1985 Stout .
5,086,844 2/1992 Mims et al. .
5,323,853 6/1994 Leismer et al. .
5,984,006 * 11/1999 Read et al. ..... 166/242.6

FOREIGN PATENT DOCUMENTS 2224525 5/1990 (GB) .
942136 12/1995 (NO) .

* cited by examiner

*Primary Examiner*—William Neuder
(74) *Attorney, Agent, or Firm*—Andrus, Sceales, Starke & Sawall, LLP

(57) ABSTRACT

Hydraulically releasable coupling (1) of the kind arranged to releasably connect a tool to a coiled tube, and which coupling (1) is provided with two or more hydraulic channels (12, 14) and (13, 15), arranged to convey hydraulic fluid from hydraulic lines, arranged in the coiled tube, to the tool; and in which the coupling (1) is held in coupled position by a locking device (4) which is secured by means of an axially displaceable sleeve (6), which again is fixed in locking position by shear pins (11). The sleeve (6) is arranged to work as a sleeve-shaped hydraulic piston, the sleeve (6) being provided with annular seals (7, 8, 9) of different seal diameters, whereby the seals (7, 8, 9) define annular areas, each assigned to a hydraulic channel (12, 14) and (13, 15). The sleeve (6) is subjected to an axially acting force equaling the sum of the products of the pressure in each of the hydraulic channels and the thereto assigned annular area. The shear pins (11) are arranged to break, whenever both annular areas are subject to hydraulic working pressure.

4 Claims, 3 Drawing Sheets

HYDRAULICALLY RELEASABLE COUPLING

BACKGROUND OF THE INVENTION

Figure 1:
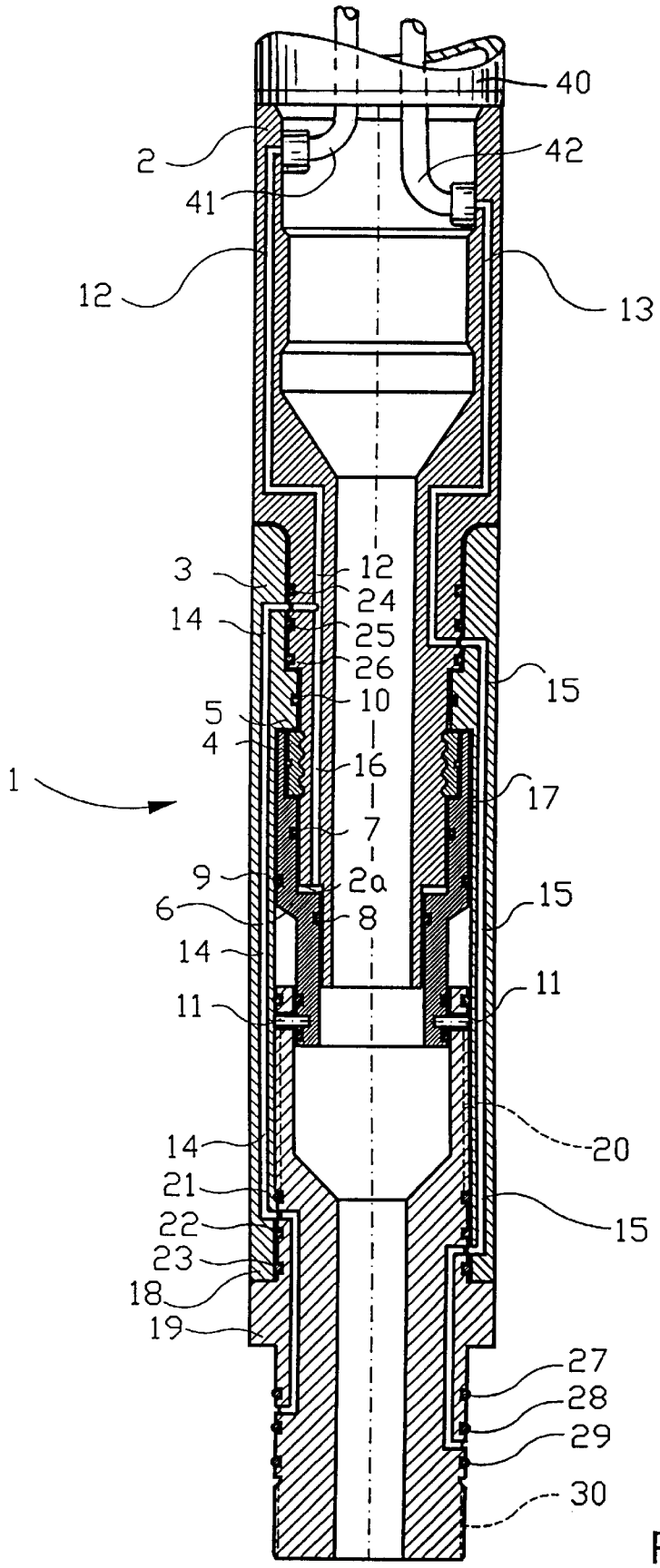

The present invention refers to a hydraulically releasable coupling, in particular for use together with equipment which is lowered into an oil or gas well.

When working in an oil or gas well, there is a need for introducing different tools and other items into the well. In wells that deviate strongly from the vertical, the tool is often attached to the end of a coiled tube, which in addition to guiding the tool, also enables circulation of the fluid in the well.

It may happen that a tool gets stuck in the well, and special equipment has to be introduced to extract the tool from the well. Before such equipment can be introduced into the well, the coiled tube must be disconnected from the stuck tool and withdrawn from the well. To enable such disconnection of the coiled tube, it is customary to fit a releasable coupling between the coiled tube and tool. Couplings of this kind comprise two sleeve-shaped main parts releasably connected, and secured in coupled position by a releasable lock. A through fluid channel allows fluid to flow from the coiled tube through the coupling, and on to the tool.

The simplest couplings are held together by shear pins which are arranged to break whenever they are subjected to a predetermined force. Detachment from a stuck tool is done by pulling on the coiled tube with sufficient force, so as to make the shear pins break. In deep wells, where there may be a considerable friction between the coiled tube and the wall of the well, it has proved difficult to transmit sufficient power to break the shear pins, and therefore they must be dimensioned to break by a relatively small force. This easily results in the shear pins breaking unintentionally, for example by vibrations and shock caused by the tool working in the well. To alleviate this problem, it is known to lock the two main parts of the coupling together by means of a locking device, which is kept in locking position by a displaceable locking sleeve, and in which the locking sleeve is kept in position by shear pins. In such known arrangements the shear pins are not subjected to shear forces when the tool is in ordinary use. Disconnecting is done by dropping a sealing body, typically a ball, through the coiled tube and down into the coupling, where the ball lands on a seat, assigned to the locking sleeve, and blocks the through fluid channel. Increasing the fluid pressure in the coiled tube, gives rise to a hydraulic force against the sealing body, and thus against the sleeve. If the fluid pressure is sufficiently increased, the force will be great enough to break the shear pins and displace the locking sleeve, so that the coupling is released. Such hydraulically releasable couplings have, because of their functional reliability, become widely used.

Some of the hydraulic tools require hydraulic control signals in addition to hydraulic power, and it is common to use a coiled tube, prefitted with two internal thin tubes, for the transmission of such hydraulic control signals. In addition the coiled tube often carries an electric cable for the transmission of electric signals to or from the tool. In such cases there is no room for dropping a sealing body through the coiled tube, and known couplings which are released by means of a sealing body, can, therefore, not be used. Thus, couplings released through pull is the only possibility left, as mentioned above.

SUMMARY OF THE INVENTION

The object of the invention is to provide a hydraulically releasable coupling, which may be used whenever hydraulic signal lines are being carried in the coiled tube to the tool, which is connected to the coiled tube by the coupling.

The object is achieved through the characteristics given in the description below and the following claims.

As mentioned, it is customary to lead at least two hydraulic signal lines through a coiled tube to hydraulic tools. The signal lines are used in a known manner, as pressure line and return line, alternately, for hydraulic fluid, to allow a hydraulic function to be reversed. Two hydraulic signal lines which alternately act as pressure line and return line, are each, according to the present invention, lead to a hydraulic piston or a defined area of a common hydraulic piston in the hydraulically releasable coupling.

The invention is based on the fact that at any time there will be an axial force acting on the locking sleeve, as a consequence of the hydraulic pressure in the hydraulic pressure line acting on one area, and a substantially smaller hydraulic pressure in the return line, acting on another area. The shear pins holding the locking sleeve in position, are dimensioned in a manner that makes the overall hydraulic force too small for the shear pins to break. The situation will be the same if the hydraulic function is reversed, so that the pressure line and the return line exchange roles. By pressurizing both hydraulic lines at the same time, a greater axial force will act on the locking sleeve, and the shear pins are dimensioned to break from such increased force.

BRIEF DESCRIPTION OF THE INVENTION

Figure 2:
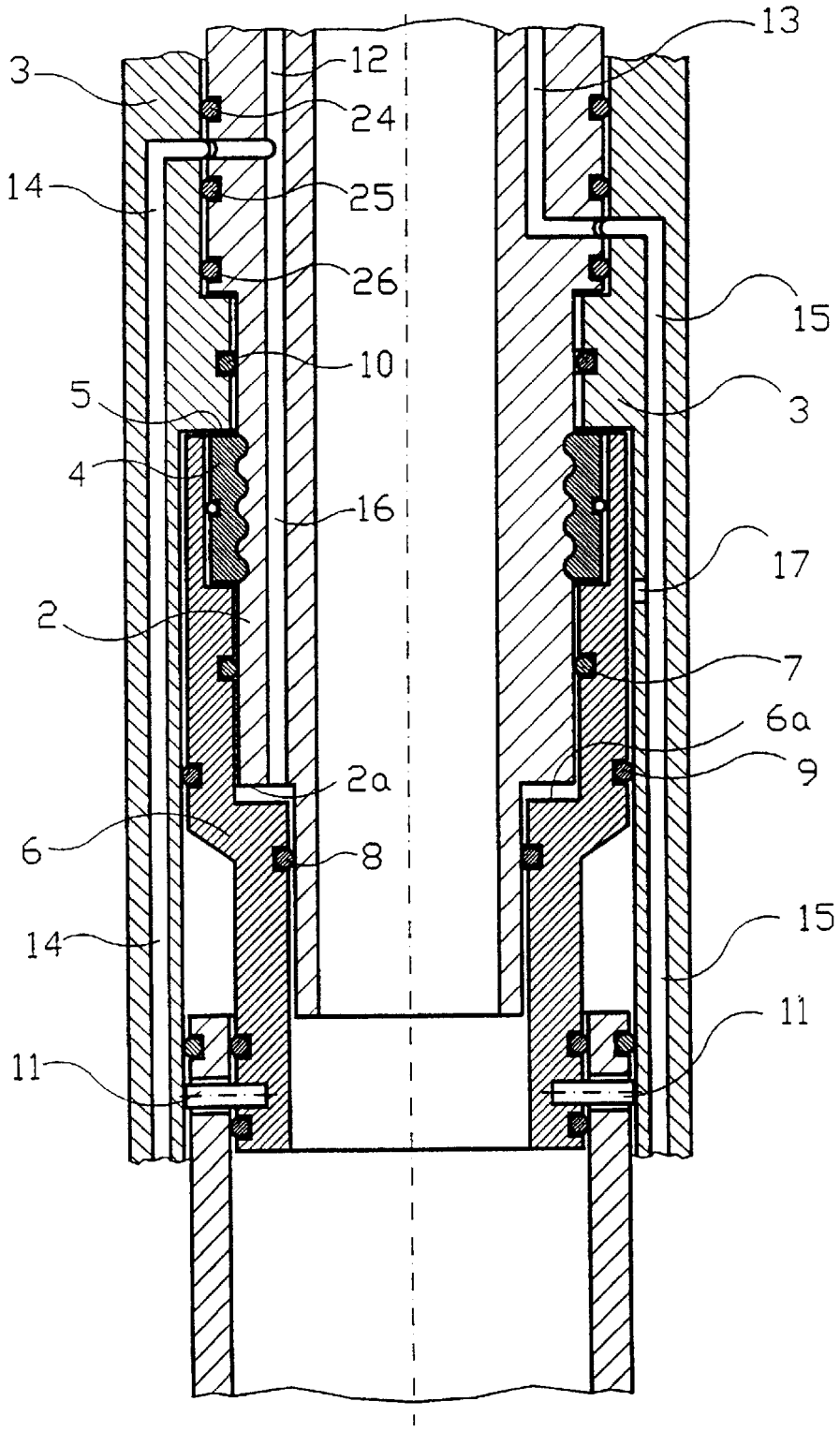
Figure 3:
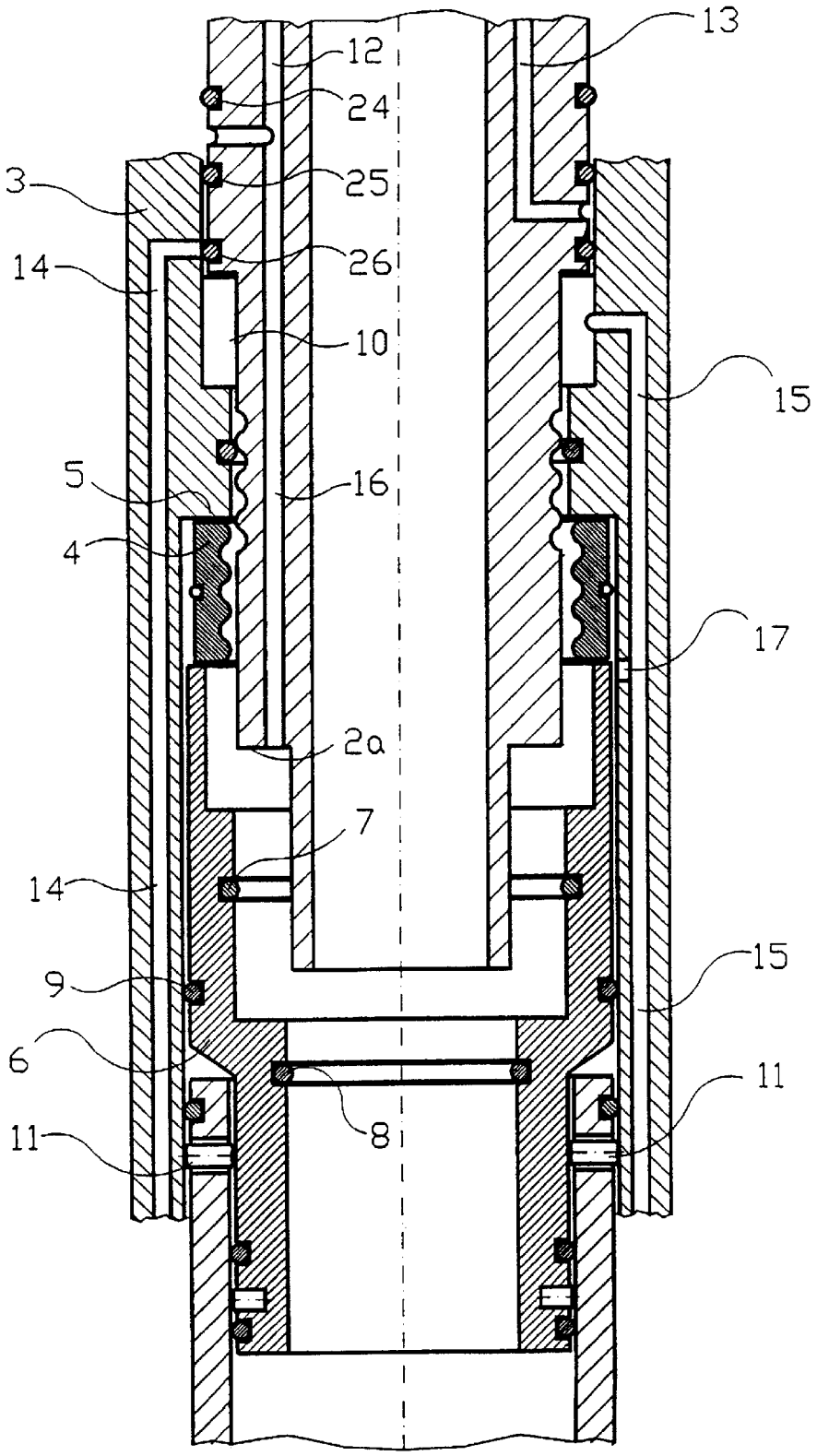

The two areas, on which acts the hydraulic pressure of the pressure line and the return line, respectively, may be arranged in various ways. A non-limiting example of an embodiment of the invention is described in the following with reference to the accompanying drawings, in which FIG. 1 is a partly sectional side view of a hydraulically releasable coupling in coupled position;

FIG. 2 is a sectional side view, and in larger scale, of a part of the coupling in coupled position; and FIG. 3 shows a part of the coupling corresponding to that in FIG. 2, after the coupling has been released.

In FIG. 1 reference 1 is a hydraulically releasable coupling in coupled position. The coupling 1 is shown in vertical position and comprises two main parts that can be separated as the coupling is released. The first main part 2 is inserted into a second main part 3. First main part 2 is arranged to be connected to coiled tube 40. The two main parts 2, 3 are held together by a radially resilient and expandable ring 4 provided with internal grooves, which engage complementary external grooves in the main part 2. A ring of this type is known from Norwegian patent application No. 942136. The ring 4 is located in an annular space between the two main parts 2, 3 and below an internal shoulder 5 of the second main part 3. When the grooves of the ring 4 are in engagement with the grooves of the main part 2, it is not possible to separate the two main parts 2, 3 from each other, the ring 4 bearing on the shoulder 5. Said annular space is big enough to accommodate expansion of the ring 4, so that the grooves of the ring 4 disengage the grooves of the main part 2. The main part 2 may then be pulled up and out of the second main part 3.

Inside the main part 3 an axially displaceable sleeve 6 is arranged, whose upper part encloses the ring 4 and prevents it from expanding. The sleeve 6 slides within the main part 3 and externally on main part 2 in the annular space between the two main parts 2, 3. The sleeve 6 is provided with an internal stepping 6*a* at its lower end, and the main part 2 is correspondingly formed with an external stepping 2*a*. The inner surface of the sleeve 6 thus bears against the main part 2 at two different diameters, and an annular seal 7 is arranged to seal between the sleeve 6 and the main part 2 at the larger diameter, while a seal 8 is arranged to seal between the sleeve 6 and the main part 2 at the smaller diameter. An annular seal 9 is arranged to seal between the sleeve 6 and the main part 3. Further, an annular seal 10 is arranged to seal between the main parts 2, 3 above the ring 4 and the sleeve 6.

The sleeve 6 is kept in position by means of shear pins 11. To release the coupling 1, so that the main parts 2, 3 may be separated, it is necessary to apply a sufficiently great downward axial force to the sleeve 6, so as to make the shear pins 11 break. Then, the sleeve 6 will, because of the same axial force, be displaced downwards and away from the ring 4, so that the ring 4 may expand within the annular space between the main parts 2, 3.

In the main part 2 there are arranged two substantially axially oriented hydraulic channels 12, 13 which are in hydraulic communication with hydraulic channels 14, 15 in the main part 3, when the main parts 2, 3 are connected. The upper ends of hydraulic channels 12 and 13 are connected to hydraulic lines 41 and 42 in coiled tube 40, respectively. Thus, in the coupled position, the coupling 1 is arranged to convey hydraulic fluid from the one end of the coupling to the other through a first channel, formed by the channels 12, 14, and a second channel, formed by the channels 13, 15. In normal operation hydraulic fluid to the well tool will pass through said channels.

Hydraulic fluid is conveyed from the first channel 12, 14 through a channel 16 in the main part 2 to an outlet at the stepping 2*a*. The hydraulic pressure in the first channel 12, 14 acts on the sleeve 6 in an annular area which is defined by the seals 7 and 8, and determined by the diameters and steppings of the sleeve 6 and the main part 2.

Hydraulic fluid is also conveyed from the second hydraulic channel 13, 15 through a port 17 to the outside of the sleeve 6, above the seal 9 which seals between the sleeve 6 and the main part 3. The hydraulic pressure in the second hydraulic channel acts on the sleeve 6 in an annular area defined by the seal 7 and the seal 9.

The sleeve 6 forms a sleeve-shaped hydraulic piston, in which three annular seals of different seal diameters define two annular areas, the first within the second. To the annular areas are assigned the first hydraulic channel 12, 14 and the second hydraulic channel 13, 15, respectively, of the coupling 1. The sleeve 6 is subjected to an axially acting force which equals the sum of the products of the pressure in each of the two hydraulic channels and the annular area assigned thereto. The shear pins 11 are arranged to break whenever the two annular areas are subjected to hydraulic working pressure.

The annular area and the shear pins 11 are also dimensioned so that the shear pins 11 cannot break from the overall axial force acting on the sleeve 6, by the highest occurring hydraulic working pressure in one of the hydraulic channels 12, 14 or 13, 15, and the simultaneously highest occurring hydraulic return pressure in the other hydraulic channel.

At the same time, the two annular areas, defined by the seals 7 and 8; 7 and 9, respectively, and the shear pins 11, are mutually dimensioned, so as to make the shear pins 11 break from the axial force developed whenever both hydraulic channels are pressurized with full working pressure.

Hydraulically controlled downhole tools may thus be used in an ordinary manner without the coupling releasing. By connecting the two hydraulic lines to a hydraulic pressure source with full working pressure, the shear pins 11 will break, and the coupling 1 will be released, thereby enabling separation of the two main parts 2 and 3.

It will be readily understood that the sleeve 6 may have other types of piston areas than the annular areas described above, assigned thereto, for example in the form of two separate hydraulic pistons, each connected to a channel 12, 14; 13, 15, respectively, whereby the pistons are arranged to effect an axial force on the sleeve 6 and thereby displace it. It will also be readily understood that it may be convenient to distribute the axial force, which is supposed to release the coupling, to more than two piston areas and correspondingly arrange more than two hydraulic control lines.

For the rest, the coupling 1 is configured in a manner known in itself, as seen from FIG. 1. The main part 3 consists of two parts, a tubular sleeve 18 and a lower part 19, which are screwed together, the sleeve 18 being provided with an internally threaded section 20 and the lower part 19 being provided with an externally threaded section. Annular seals 21, 22, 23 define annular slots in which the hydraulic channels 14, 15 are lead from the sleeve 18 to the lower part 19 in a manner known in itself. Correspondingly, the annular seals 24, 25 and 26 define annular slots through which the channels 14, 15 communicate with the channels 12, 13 of the first main part 2. In the same way, annular seals 27, 28, 29 on the lower part 19 will define the annular slots when the lower part 19 is connected to a not shown tool, to create a hydraulic connection between the channels 14, 15 and the corresponding channels in the tool. The lower part 19 of the coupling 1 is provided with a threaded section 30 into which the tool may be screwed. The upper end of the coupling 1 is correspondingly arranged to be connected to coiled tube 40, which, in its lower end, is provided with a coupling device corresponding to the lower end 19 of the coupling 1. Thereby is achieved a hydraulic connection from to the two hydraulic lines 41, 42 in the coiled tube, through the channels 12, 13 in the first part 2 of the coupling 1, through the annular slots between the seals 24, 25, 26 and to the channels 14, 15 and out into the annular slots between the seals 27, 28 and 29 to the tool.

What is claimed is:

1. A hydraulically releasable coupling (1) for releasably connecting a tool to an end of a tubing that extends into a well in the ground, the tubing having a pair of hydraulic fluid lines extending therealong for supplying hydraulic fluid to, and receiving hydraulic fluid from, the tool, said coupling comprising:

a first main part (2) adapted to connect to the end of the tubing;

a second main part (3) adapted to connect to the tool, said second main part being tubular, at least a portion of said first main part being insertable in said second main part along an axis of said tubular second main part for being positioned within said second main part when the tool is connected to the tubing, said first main part being removable from said second main part to disconnect the tool from the tubing;

said first and second main parts having a first pair of mating hydraulic fluid conduits (12,14) providing a first fluid path between one of the hydraulic fluid lines and the tool when the tool is connected to the tubing for supplying pressurized hydraulic fluid to the tool at working pressures for operating the tool, said first and second main parts having a second pair of mating hydraulic fluid conduits (13,15) providing a second fluid path between the other of the hydraulic fluid lines and the tool when the tool is connected to the tubing for returning hydraulic fluid from the tool when the tool is operating at a return pressure less than the working pressure, a sleeve (6) surrounding the portion of said first main part inserted in said second main part, said sleeve being displaceable between first and second positions along the axis of said second main part;

at least one shearable pin (11) coupling said sleeve to said second main part, said sleeve being moveable with respect to said second main part when said pin is sheared;

a radially resilient, expandable ring (4) interposed between said sleeve and said inserted portion of said first main part, said sleeve when in said first position preventing expansion of said ring to cause said ring to engage said inserted portion of said first main part to retain said sleeve and second main part on said first main part to connect the tool to the tubing, movement of said sleeve to said second position allowing said ring to expand and disengage from said inserted portion of said first main part so that said first main part can be removed from said second main part to disconnect the tool from the tubing;

said sleeve defining, with said first main part, a pair of hydraulic fluid chambers for receiving pressurized hydraulic fluid to exert axially directed forces on said sleeve urging said sleeve to move from said first position to said second position; and first port means for placing a first chamber of said pair of chambers in fluid communication with said first fluid path to supply hydraulic fluid to said first chamber, and second port means for placing a second chamber of said pair of chambers in fluid communication with said second fluid path to supply hydraulic fluid to said second chamber said chambers being formed to provide areas thereof over which pressures are applied by the hydraulic fluid to generate axially directed forces on said sleeve;

whereby, when said tool is being operated, said first port means supplies pressurized hydraulic fluid at working pressures to said first chamber and said second port means supplies pressurized hydraulic fluid at the lower, return pressure to said second chamber, the forces exerted on said sleeve by either or both of the highest occurring working pressure and the highest simultaneously occurring return pressure being insufficient to shear said pin, and whereby to disconnect the tool from the tubing, said first port means supplies pressurized hydraulic fluid at a full working pressure to said first chamber and said second port means also supplies pressurized hydraulic fluid at a full working pressure to said second chamber, the combined axially directed forces exerted on said sleeve when both said first and second port means supply full working pressure being sufficient to shear said shear pin to allow movement of said sleeve to said second position to disengage said first and second main parts and disconnect the tool from the tubing.

2. A hydraulically releasable coupling as set forth in claim 1 wherein said pair of hydraulic fluid chambers are further defined as annular fluid chambers formed to surround the axis of said second main part and lying at differing radii from said axis.

3. A hydraulically releasable coupling as set forth in claim 2 wherein said chambers are formed by annular seals between said first main part and said sleeve.

4. A hydraulically releasable coupling as set forth in claim 1 wherein said sleeve is further defined as having a portion embracing said ring when said sleeve is in the first position for preventing expansion of said ring, movement of said sleeve to said second position when the shear pin is sheared removing the embrace of said ring by said sleeve to allow said ring to expand.

* * * * *